US007314438B1

(12) United States Patent
Clark et al.

(10) Patent No.: US 7,314,438 B1
(45) Date of Patent: Jan. 1, 2008

(54) HAND-OPERABLE EXERCISE BAR

(76) Inventors: Carol Clark, 17944 SW. 13th St., Pembroke Pines, FL (US) 33029-4915; Rickie Clark, 17944 SW. 13th St., Pembroke Pines, FL (US) 33029-4915

( * ) Notice: Subject to any disclaimer, the term of this patent is extended or adjusted under 35 U.S.C. 154(b) by 0 days.

(21) Appl. No.: 11/291,471

(22) Filed: Dec. 2, 2005

(51) Int. Cl.
*A63B 21/02* (2006.01)

(52) U.S. Cl. ..... 482/126; 482/107

(58) Field of Classification Search ..... 482/91, 482/121, 102, 104, 105, 106, 107, 38, 62, 482/126, 108, 109, 49, 50; D21/665, 662, D21/681, 682
See application file for complete search history.

(56) References Cited

U.S. PATENT DOCUMENTS

| | | | | |
|---|---|---|---|---|
| 3,764,131 | A | 10/1973 | Hughes | |
| 3,830,493 | A | 8/1974 | Miller | |
| 4,218,057 | A * | 8/1980 | Wilson | 482/93 |
| 4,257,591 | A * | 3/1981 | Evans, Sr. | 482/91 |
| 4,538,806 | A * | 9/1985 | Wilkerson | 482/108 |
| 4,643,417 | A | 2/1987 | Nieman | |
| 4,838,542 | A | 6/1989 | Wilkinson | |
| 4,863,158 | A * | 9/1989 | Tassone | 482/140 |
| 4,869,491 | A | 9/1989 | Nolan | |
| 4,948,123 | A * | 8/1990 | Schook | 482/107 |
| 5,062,633 | A * | 11/1991 | Engel et al. | 482/118 |
| 5,484,367 | A * | 1/1996 | Martinez | 482/107 |
| 5,776,034 | A | 7/1998 | Stamler | |
| 5,830,110 | A * | 11/1998 | Fielding | 482/44 |
| 6,857,994 | B2 * | 2/2005 | Yu | 482/126 |
| 2003/0125171 | A1 * | 7/2003 | He | 482/126 |
| 2004/0152571 | A1 * | 8/2004 | Udwin | 482/128 |
| 2004/0242385 | A1 * | 12/2004 | Emick | 482/106 |

* cited by examiner

*Primary Examiner*—Lori Amerson
*Assistant Examiner*—Sundhara M Ganesan

(57) ABSTRACT

An exercise apparatus includes first and second handles that fit within a user's hands and are formed from non-porous and water impermeable material. Each handle has a medially disposed end provided with a disc-shaped region and a central cylindrical region. The central region is intercalated between first and second disc-shaped regions and has a diameter smaller than corresponding diameters of the disc-shaped regions. Elongated and hollow shafts have lateral ends conjoined with the medial ends of the handles. The shafts have coextensive lengths and arcuate shapes. The lateral end is conjoined to the handles. A mechanism is included for attaching the shafts together such that the second shaft partially slides into the first shaft. Portable weight members are attached to the handles, against the central regions. A helical spring member is housed within one handle and abuts the first shaft, providing a resistive force against which the shaft is engaged.

5 Claims, 2 Drawing Sheets

HAND-OPERABLE EXERCISE BAR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to exercise bars and, more particularly, to a hand-operable exercise bar for toning an upper muscular region of a body while a person is walking and/or jogging.

2. Prior Art

People in all walks of life can benefit from increasing the strength in their wrists and forearms. There are various pieces of exercise equipment that may be used to develop strength in the wrists and forearms. Such equipment includes weights suspended from ropes, compression exercisers which comprise of springs or other resilient materials that can be squeezed in a user's hand, and small bar bells. Much of this equipment is not easily portable.

There are hand and wrist exercisers of the general type which include a pair of hand grips which are mounted generally coaxially to each other and which can be rotated relative to each other against a resistance force. Such devices can be made to be lightweight and portable. A user can use such devices to develop his or her forearm muscles by counter-rotating the hand grips against the resistance force. Users of such devices can also benefit by loosening and stretching the muscles and tendons of their wrists.

A problem with some such wrist exercisers is that the length between the hand grips is fixed and cannot be adjusted. Consequently, a wrist exerciser which may be suitable for use by one individual may be too large or too small for another individual. The exerciser may thus offer too little or too much resistance to provide sufficient exercise to other individuals. Some other exercise devices of this general type allow the resistance force to be adjusted. However, often the adjustments are not particularly precise or repeatable, thus the resistance setting tends to change as the hand grips on the device are rotated while a user exercises. Finally, many such previous devices do not provide accurate, repeatable calibration of the resistance provided by the device.

Accordingly, a need remains for a hand-operable exercise bar in order to overcome the above-noted shortcomings. The present invention satisfies such a need by providing an exercise bar that is easy and convenient to use, has an adjustable length, is relatively light weight in design, and allows a fitness enthusiast to exercise his upper body while walking or jogging. Such an exercise apparatus provides an effective way to exercise one's arms and upper body. The versatility of the exercise bar makes it appealing since the user can maximize the benefits that they received from the time they spent working out. This is particularly appealing for a busy person who does not have time to walk and then spend additional time exercising their upper body.

BRIEF SUMMARY OF THE INVENTION

In view of the foregoing background, it is therefore an object of the present invention to provide a hand-operable exercise bar. These and other objects, features, and advantages of the invention are provided by a portable exercise apparatus for toning an upper muscular region of a body while a person is walking and/or jogging.

The exercise apparatus includes first and second handles that are suitably sized and shaped for comfortably fitting within left and right hands of a user respectively. Such first and second handles are formed from non-porous and water impermeable material for advantageously and effectively resisting body fluid excretions during exercising procedures. Each of the first and second handles have medially disposed end portions provided with first and second spaced disc-shaped regions and a central cylindrical region monolithically formed with the first and second disc-shaped regions respectively. Such a central region is intercalated between the first and second disc-shaped regions and has a diameter smaller than corresponding diameters of the first and second disc-shaped regions for defining an annular path along an outer surface of the central region.

The first and second handles preferably include a plurality of indentations selectively spaced along longitudinal lengths thereof for conveniently and comfortably receiving metacarpals of the user thereon. Such first and second handles may further include a linear stop member monolithically formed with the first and second disc-shaped regions. The linear stop member bifurcates the central portion and provides a gripping surface against which the weight members are directly engaged, thereby effectively and conveniently maintaining the weight members at static positions.

First and second elongated shafts have lateral ends directly conjoined with the medial ends of the first and second handles respectively. Such first and second shafts are hollow, have coextensive longitudinal lengths, and further have arcuate shapes extending intermediately between the first and second handles. The lateral end is statically and permanently conjoined to the first and second handles. A helical spring member is housed within one of the handles. Such a helical spring member abuts the first shaft for providing a resistive force against which the first shaft is engaged during exercising conditions.

A mechanism is included for removably attaching the first and second shafts directly together such that the second shaft partially slides into the first shaft. Such a removably attaching mechanism preferably includes a resiliently formed detent that has first and second linear portions partially protruding outwardly from the second shaft. A plurality of rectangular members are directly conjoined with the first and second linear portions. Such rectangular members are resiliently adaptable between compressed and expanded positions for effectively biasing the first and second linear portions outwardly through the second shaft respectively. The rectangular members are preferably housed within the second shaft. The first shaft is provided with a plurality apertures formed therein that are equidistantly spaced apart for simultaneously receiving the first and second linear portions therethrough.

A plurality of portable weight members are removably attached directly to the first and second handles respectively. Such weight members are directly positioned against the central regions and are statically engaged therewith during exercising procedures. The weight members may be coextensively shaped and seated laterally of the first and second shafts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
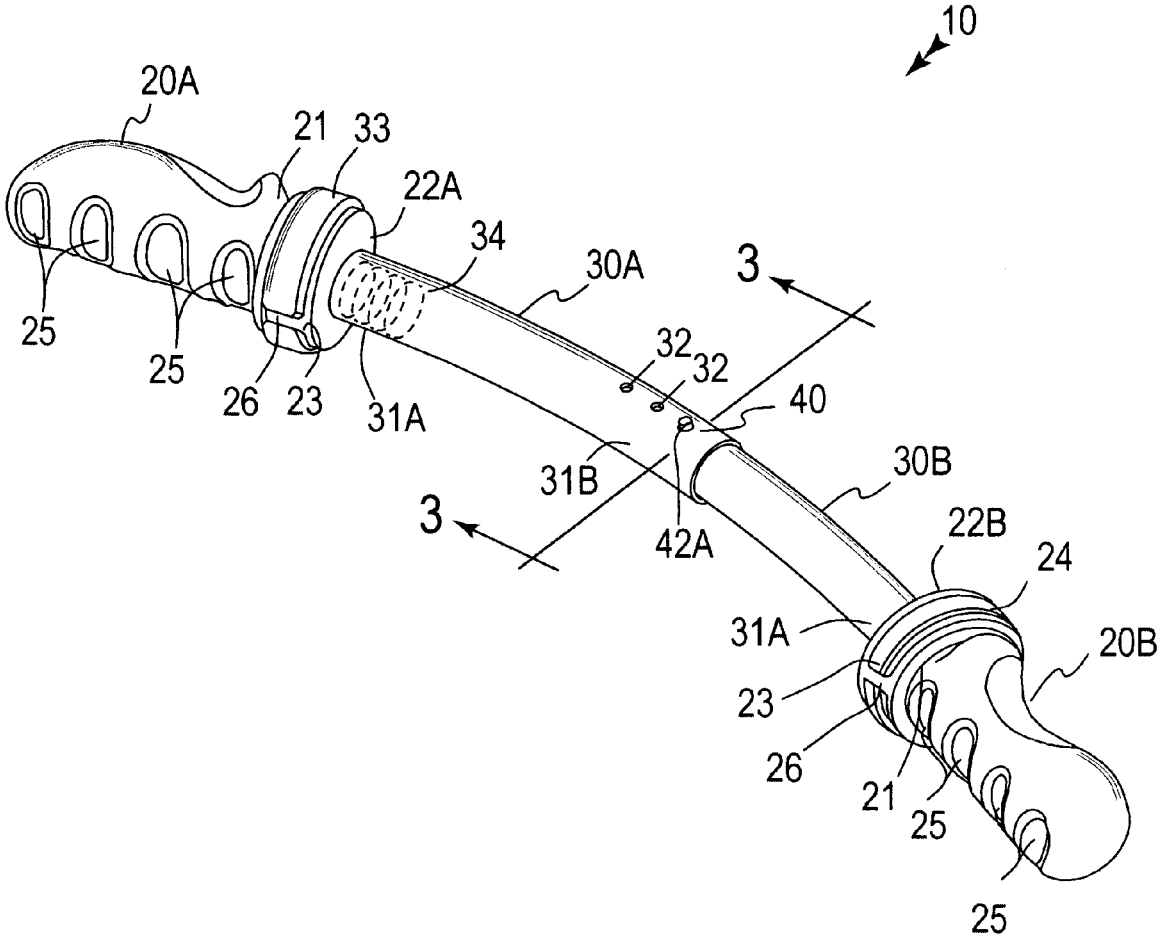
FIG. 1 is a perspective view showing a hand-operable exercise bar, in accordance with the present invention.
Figure 2:
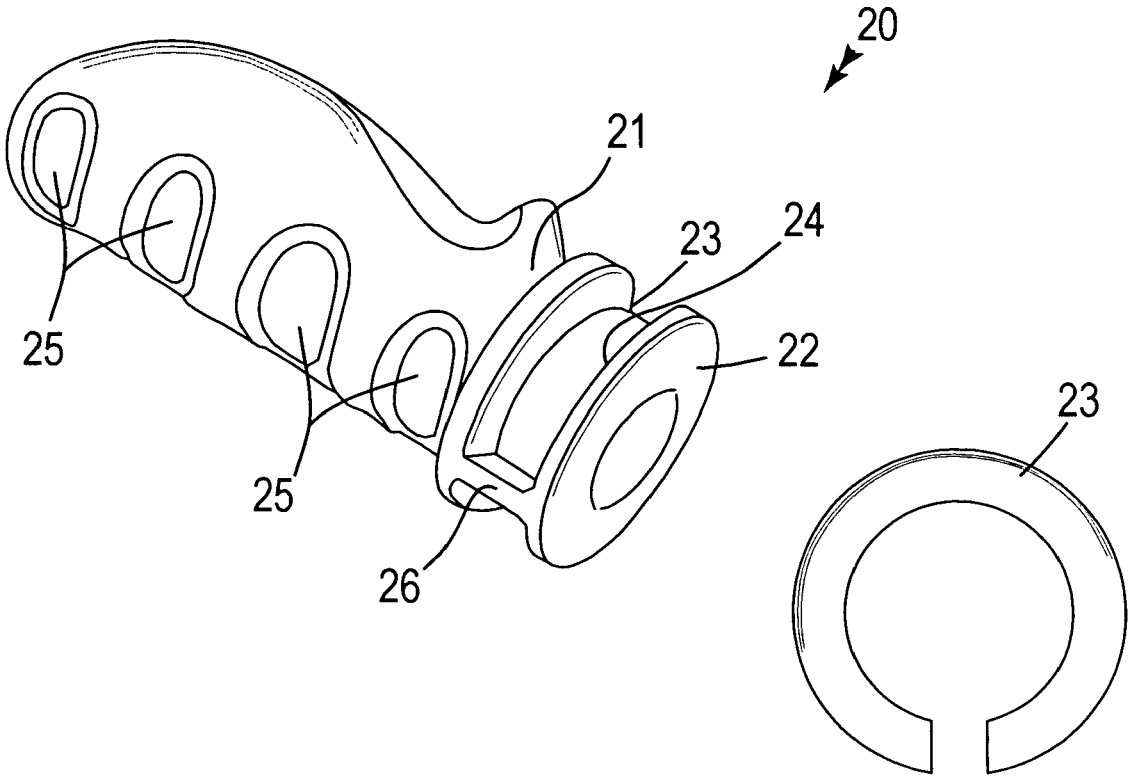
FIG. 2 is an enlarged perspective view of one of the handles and of a weight member shown in FIG. 1.
Figure 3:
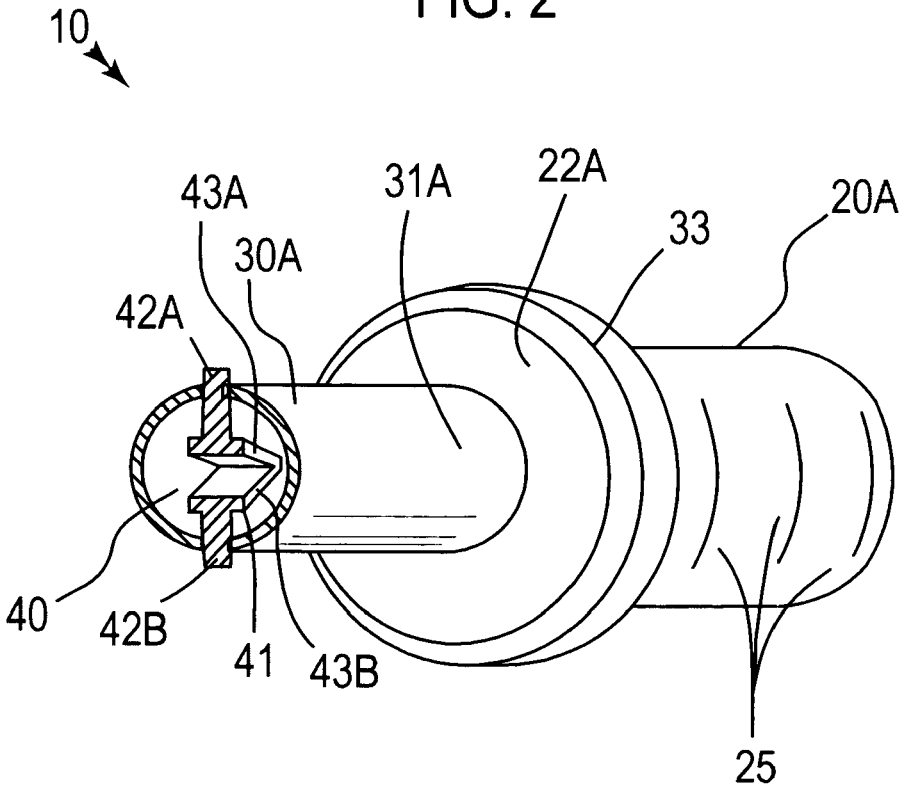
FIG. 3 is a cross-sectional view of the apparatus shown in FIG. 1, taken along line 3-3 and showing the removably attaching mechanism.

The apparatus of this invention is referred to generally in FIGS. 1-3 by the reference numeral 10 and is intended to provide a hand-operable exercise bar. It should be understood that the apparatus 10 may be used to exercise many different types of muscle groups and should not be limited in use to only working out the user's forearms and wrists.

Referring initially to FIGS. 1 through 3, the apparatus 10 includes first 20A and second 20B handles that are suitably sized and shaped for comfortably fitting within left and right hands of a user respectively. Such first 20A and second 20B handles are formed from non-porous and water impermeable material, which is essential and advantageous for effectively resisting body fluid excretions during exercising procedures. This feature prevents the handles 20 from being impregnated with bodily fluids, such as sebaceous gland excretions, thus maintaining the sanitary nature of the first 20A and second 20B handles, which is critical for allowing more than one person to use the same apparatus 10. Each of the first 20A and second 20B handles have medially disposed end portions 21 provided with first 22A and second 22B spaced disc-shaped regions and a central cylindrical region 23 monolithically formed with the first 22A and second 22B disc-shaped regions respectively. Such a central region 23 is intercalated between the first 22A and second 22B disc-shaped regions and has a diameter smaller than corresponding diameters of the first 22A and second 22B disc-shaped regions, which is important for defining an annular path along an outer surface 24 of the central region 23.

Still referring to FIGS. 1 through 3, the first 20A and second 20B handles include a plurality of indentations 25 selectively spaced along longitudinal lengths thereof for conveniently and comfortably receiving metacarpals of the user thereon. Such first 20A and second 20B handles further include a linear stop member 26 monolithically formed with the first 22A and second 22B disc-shaped regions. The linear stop member 26 bifurcates the central region 23 and provides a gripping surface against which the weight members 33 (described herein below) are directly engaged, without the use of intervening elements, which is vital for effectively and conveniently maintaining the weight members 33 at static positions during operating conditions.

Referring to FIGS. 1 and 3, first 30A and second 30B elongated shafts have lateral ends 31A directly conjoined, without the use of intervening elements, with the medial ends 21 of the first 20A and second 20B handles respectively. Such first 30A and second 30B shafts are hollow, have coextensive longitudinal lengths, and further have arcuate shapes extending intermediately between the first 20A and second 20B handles. The lateral end 31A is statically and permanently conjoined, without the use of intervening elements, to the first 20A and second 20B handles.

Again referring to FIGS. 1 and 3, a mechanism 40 is included for removably attaching the first 30A and second 30B shafts directly together, without the use of intervening elements, such that the second shaft 30B partially slides into the first shaft 30A. Such a removably attaching mechanism 40 includes a resiliently formed detent 41 that has first 42A and second 42B linear portions partially protruding outwardly from the second shaft 30B, as is best shown in FIG. 3. A plurality of rectangular members 43 are directly conjoined, without the use of intervening elements, with the first 42A and second 42B linear portions. Such rectangular members 43 are resiliently adaptable between compressed and expanded positions, which is crucial for effectively biasing the first 42A and second 42B linear portions outwardly through the second shaft 30B respectively. The rectangular members 43 are housed within the second shaft 30B. The first shaft 30A is provided with a plurality apertures 32 formed at a medial end 31B thereof that are equidistantly spaced apart for simultaneously receiving the first 42A and second 42B linear portions therethrough.

Referring to FIGS. 1 and 2, a plurality of portable weight members 33 are removably attached directly, without the use of intervening elements, to the first 20A and second 20B handles respectively. Such weight members 33 are directly positioned, without the use of intervening elements, against the central regions 23 and are statically engaged therewith during exercising procedures. The weight members 33 are coextensively shaped and seated laterally of the first 30A and second 30B shafts. Of course, the apparatus 10 may be provided with a plurality weight members 33 having alternate weights for conveniently allowing a user to adjust the resistance of the apparatus 10 to their own needs, as is obvious to a person of ordinary skill in the art.

Referring to FIG. 1, a helical spring member 34 is housed within the first handle 20A. Such a helical spring member 34 abuts the first shaft 30A and is essential for providing a resistive force against which the first shaft 30A is engaged during exercising conditions. Of course, the helical spring member 34 may be produced in a variety of tension levels for increasing or decreasing the amount of resistance offered by the apparatus 10, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable exercise apparatus for toning an upper muscular region of a body while a person is walking/jogging, said exercise apparatus comprising:

first and second handles suitably sized and shaped for fitting within left and right hands of a user respectively, said first and second handles being formed from non-porous and water impermeable material for resisting body fluid excretions during exercising procedures, each said first and second handles having medially disposed end portions provided with first and second spaced disc-shaped regions and a central cylindrical region monolithically formed with said first and second disc-shaped regions respectively, said central region being intercalated between said first and second disc-shaped regions and having a diameter smaller than corresponding diameters of said first and second disc-shaped regions for defining an annular path along an outer surface of said central region;

first and second elongated shafts having lateral ends directly conjoined with said medial ends of said first and second handles respectively, wherein said first and second shafts are hollow, said first and second shafts having coextensive longitudinal lengths and further having arcuate shapes extending intermediately between said first and second handles, said lateral end being statically and permanently conjoined to said first and second handles;

means for removably attaching said first and second shafts directly together such that said second shaft partially slides into said first shaft; and a plurality of portable weight members removably attached directly to said first and second handles respectively, said weight members being directly positioned against said central regions and statically engaged therewith during exercising procedures;

wherein said first and second handles further comprise a linear stop member monolithically formed with said first and second disc-shaped regions, said linear stop member bifurcating said central portion and providing a gripping surface against which said weight members are directly engaged and thereby maintaining said weight members at static positions;

wherein each of said central regions are counter sunk and offset from said first and second disc-shaped regions respectively, each of said weight members having opposed ends spaced apart and engaged with opposed faces of said stop members respectively wherein said weight members are medially positioned in between said first and second disc-shaped regions respectively.

2. The apparatus of claim 1, wherein said weight members are coextensively shaped and seated laterally of said first and second shafts.

3. The apparatus of claim 1, wherein said removably attaching means comprises:

a resiliently formed detent having first and second linear portions partially protruding outwardly from said second shaft; and a plurality of rectangular members directly conjoined with said first and second linear portions, said rectangular members being resiliently adaptable between compressed and expanded positions for biasing said first and second linear portions outwardly through said second shaft respectively;

wherein said first shaft is provided with a plurality apertures formed therein and equidistantly spaced apart for simultaneously receiving said first and second linear portions therethrough.

4. The apparatus of claim 1, wherein said first and second handles comprise:

a plurality of indentations selectively spaced along longitudinal lengths thereof for receiving metacarpals of the user thereon.

5. The apparatus of claim 3, wherein said rectangular members are housed within said second shaft.

* * * * *